US005964460A

United States Patent [19]

Azumi et al.

[11] Patent Number: 5,964,460

[45] Date of Patent: Oct. 12, 1999

[54] COPYING DEVICE WITH A PRINTING MEDIUM DETECTING DEVICE

[75] Inventors: Shinichi Azumi, Yamatotakada; Kouji Yamaji, Kyoto, both of Japan

[73] Assignee: Sharp Kabushiki Kaisha, Osaka, Japan

[21] Appl. No.: 08/907,889

[22] Filed: Aug. 11, 1997

[30] Foreign Application Priority Data

Oct. 9, 1996 [JP] Japan ..... 8-268075

[51] Int. Cl.[6] ..... B65H 7/02

[52] U.S. Cl. ..... 271/265.01; 271/265.02; 271/258.05; 271/259; 271/258.01

[58] Field of Search ..... 271/111, 110, 271/258.01, 259, 258.05, 265.01, 265.02, 4.02

[56] References Cited

U.S. PATENT DOCUMENTS

| | | | |
|---|---|---|---|
| 3,762,813 | 10/1973 | Fowlie et al. | 271/111 |
| 4,203,585 | 5/1980 | Kunz et al. | 271/111 |
| 4,310,153 | 1/1982 | Kikuchi | 271/259 |
| 4,357,007 | 11/1982 | Mens Franciscus | 271/111 |
| 4,600,185 | 7/1986 | Moll | 271/265.01 |
| 4,632,379 | 12/1986 | Steinhilber | 271/111 |
| 4,671,441 | 6/1987 | Hauslaib | 271/111 |
| 4,793,605 | 12/1988 | Tajima | 271/265.01 |
| 4,893,804 | 1/1990 | Sasage et al. | 271/111 |
| 5,022,642 | 6/1991 | Hasegawa et al. | 271/110 |
| 5,035,413 | 7/1991 | Yamada et al. | 271/265.02 |
| 5,423,527 | 6/1995 | Tranquilla | 271/259 |
| 5,582,399 | 12/1996 | Sugiura | 271/265.01 |

FOREIGN PATENT DOCUMENTS

| | | | |
|---|---|---|---|
| 428922 | 5/1991 | European Pat. Off. | 271/228 |
| 677467 | 10/1995 | European Pat. Off. | 271/228 |
| 4234694 | 4/1993 | Germany | 271/259 |
| 5-94060 | 4/1993 | Japan | 271/259 |
| 2299070 | 9/1996 | United Kingdom | 271/259 |

*Primary Examiner*—William E. Terrell
*Assistant Examiner*—Wonki K. Park

[57] ABSTRACT

Sheets stacked on the sheet tray are delivered and fed one by one along the sheet conveyance path by the rotation of a sheet-feed roller in cooperation with a frictional member. The sheet conveyance path has a sheet-feed actuator provided thereon for detecting a sheet being conveyed and further has a sheet-pass actuator provided thereon between the sheet-feed actuator and the sheet-feed roller. Two slit arms of the sheet-feed and sheet-pass actuators are arranged so as to interrupt the optical path of a common optical sensor. When the rear of a preceding sheet being conveyed has passed by the sheet-pass actuator, the optical sensor detects the state. In response to this detection, a signal for starting the delivery of the next sheet is launched, thus reducing the interval between sheets.

14 Claims, 10 Drawing Sheets

COPYING DEVICE WITH A PRINTING MEDIUM DETECTING DEVICE

BACKGROUND OF THE INVENTION (1) Field of the Invention

The present invention relates to a sheet delivering and feeding device for use in a copier, printer, plain paper facsimile, etc., in particular relating to a sheet delivering and feeding device which delivers sheets as recording medium, one by one, to the image forming station, providing a prescribed sheet distance between one and the next.

(2) Description of the Prior Art

Copiers, printers, plain paper facsimiles and other image forming apparatuses have a sheet delivering and feeding device, that is, a device for delivering sheets, one by one, to the image forming station, providing a prescribed sheet distance between one and the next sheet.

For example, an image forming apparatus shown in FIG. 2, has a sheet delivering and feeding device 101 in which sheets 105 stacked on a sheet tray 108 in the sheet delivering and feeding portion 101 are delivered one by one from the topmost sheet by the function of a feed roller 112. Feed roller 112 has a frictional member 113 pressed thereagainst in order to stop double delivery of sheets. That is, when two sheets are fed therebetween, only the top sheet is delivered while the delivery of the lower sheet is stopped by frictional member 113, thus achieving sheet-by-sheet feeding.

The sheet thus delivered is detected by a sheet feed sensor 115 as a sheet feed detecting means, sensing its front end, prior to the delivery to the image forming station, in particular, the transfer position. In time with the detection of the front end of the sheet, the operation of forming an image on a photoreceptor drum 121 is started. In this way, the time when the front end of the sheet reaches the transfer position, more specifically, the contact nip between a transfer roller 122 and photoreceptor drum 121, is synchronized with the front end of the image formed on the surface of photoreceptor drum 121.

Rotation of feed roller 112 is stopped at a time (e.g., after a certain elapse of time based on a timer) after the front end of the sheet passed by sheet feed sensor 115 and has been held between photoreceptor drum 121 and transfer roller 122. Then, after the rear of the sheet passes by sheet feed sensor 115, a sheet-pickup signal for triggering the drive to feed roller 112 for delivering the next sheet to the image forming station is produced. In this way, the sheets will be successively delivered sheet by sheet with a prescribed sheet distance in between, avoiding overlap between the rear of the delivered sheet and the front of the subsequent sheet.

In accordance with the above conventional art shown in part by FIG. 3, it is possible to perform successive sheet feeding by avoiding overlap between the rear of the preceding sheet and the front of the next sheet, but the interval between the two successive sheets delivered is constrained, even in the optimal case, by the distance between the sheet feed sensor and the feed roller unit. Therefore, it is impossible to further shorten the sheet interval. As a result, it is impossible to enhance the print speed or shorten the time from feeding a sheet to print-out, without increasing the rotational speed of photoreceptor 121.

Repeatedly, when the speed of forming an image on the photoreceptor cannot be increased, it is impossible to further enhance the print speed if the interval between sheets is determined by the distance between the sheet feed sensor and the feed roller as stated above. In particular, in the configuration where a sheet feed sensor detects the front end of the sheet and this detection is used for generating a timing signal for starting the operation of forming an image on the photoreceptor, if feeding of the next sheet is performed in response to this timing signal, it is impossible to shorten the sheet interval by any means and hence it is practically unfeasible to enhance the print speed by shortening the sheet interval.

In the paper delivering and feeding device shown in FIG. 2, after the completion of the feeding operation of a single sheet by means of feed roller 112, the operation of feed roller 112 is stopped but, it is passively rotated by the sheet being conveyed. Accordingly, when the rear of the sheet passes by feed roller 112, the front end of the next sheet may enter and pass by the position of frictional member 113 in conformity with the rotation of feed roller 112 so that it may be set into a stand-by state where the front end is drawn past (in the dragged state). In this state, the delivery of the next sheet, will be started when feed roller 112 starts to be rotated after the rear of the preceding sheet is detected by sheet feed sensor 115 as described above. Therefore, the sheet interval may be inconsistent depending upon the delivered state of the next sheet, and will optimally be the distance between sheet feed sensor 115 and feed roller 112.

As stated above, in the conventional art, since the start of feeding the next sheet is controlled in response to the detection of the rear of the preceding sheet by sheet feed sensor 115, the interval between sheets will be definitely determined by the distance between the feed roller and the sheet feed sensor. The only way to further shorten the sheet interval, would depend on expectation that the next sheet may be delivered simultaneously with the passage of the rear of the preceding sheet through the sensor. However, this cannot be realized and therefore cannot be a factor which provides stably consistent shortening of the sheet interval.

SUMMARY OF THE INVENTION

In view of the above problems, it is therefore an object of the present invention to provide a sheet delivering and feeding device which can shorten the interval between sheets to be delivered as much as possible so as to practically improve the speed of image forming.

In particular, it is an object of the invention to make the sheet interval as short as possible, or reduce the maximum interval between sheets so as to increase the number of sheets passing per unit time and therefore practically achieve fast printing operations.

In order to attain the above objects, the present invention is configurated as follows:

The first aspect of the invention resides in a sheet delivering and feeding device comprising:

- a sheet tray for having sheets stacked thereon;
- a feed roller for delivering sheets one by one from the sheet tray;
- a frictional member disposed opposite the feed roller for preventing multiple delivery of sheets;
- a sheet-feed detecting means for detecting the sheet delivered by the feed roller to produce a signal instructing the start of the operation; and
- a sheet-pass detecting means disposed in the sheet conveyance path between the sheet-feed detecting means and the feed roller for detecting the front and rear ends of the sheet conveyed along the sheet conveyance path, wherein the start of the feed roller of delivering a sheet is controlled in accordance with the detection states of the sheet-feed detecting means and the sheet-pass detecting means.

The second aspect of the invention resides in the sheet delivering and feeding device defined in the above first feature, wherein the sheet-feed detecting means is disposed in the sheet conveyance path and comprises a sheet-feed actuator which is swayed by the delivered sheet and a sensor which detects the swaying state of the sheet-feed actuator to produce a signal indicating the sheet delivery and feeding state; and the sheet-pass detecting means is disposed in the sheet conveyance path and comprises a sheet-pass actuator which is swayed by the delivered sheet while the swaying state of the sheet-pass actuator is detected by the same sensor to detect the sheet delivery and feeding state.

The third aspect of the invention resides in the sheet delivering and feeding device defined in the above first feature, wherein the sheet-pass detecting means is disposed at the approximately center between the sheet-feed detecting means and the sheet tray.

The fourth aspect of the invention resides in the sheet delivering and feeding device defined in the above second feature, wherein the sheet-pass detecting means is disposed at the approximately center between the sheet-feed detecting means and the sheet tray.

The fifth aspect of the invention resides in the sheet delivering and feeding device defined in the above first feature, wherein the operation of the feed roller for delivering a sheet is started when the sheet-pass detecting means has detected the rear of the preceding sheet; and when the front end of the subsequent sheet has been dragged in the sheet-pass detecting means and is detected thereby, the feed roller is started when the sheet-feed detecting means has detected the rear of the preceding sheet.

The sixth aspect of the invention resides in the sheet delivering and feeding device defined in the above second feature, wherein the operation of the feed roller for delivering a sheet is started when the sheet-pass detecting means has detected the rear of the preceding sheet; and when the front end of the subsequent sheet has been dragged in the sheet-pass detecting means and is detected thereby, the feed roller is started when the sheet-feed detecting means has detected the rear of the preceding sheet.

The seventh aspect of the invention resides in the sheet delivering and feeding device defined in the above first feature, wherein the operational range within which the sheet-feed detecting means detects sheets is set shorter than that within which the sheet-pass detecting means detect sheets.

The eighth aspect of the invention resides in the sheet delivering and feeding device defined in the above second feature, wherein the operational range within which the sheet-feed detecting means detects sheets is set shorter than that within which the sheet-pass detecting means detect sheets.

The ninth aspect of the invention resides in the sheet delivering and feeding device defined in the above fifth feature, wherein when the operational range within which the sheet-feed detecting means detects sheets is set longer than that within which the sheet-pass detecting means detect sheets, the operation of the feed roller for delivering a sheet is started after a certain elapse of time from when the rear of the preceding sheet was detected by the sheet-pass detecting means.

The tenth aspect of the invention resides in the sheet delivering and feeding device defined in the above sixth feature, wherein when the operational range within which the sheet-feed detecting means detects sheets is set longer than that within which the sheet-pass detecting means detect sheets, the operation of the feed roller for delivering a sheet is started after a certain elapse of time from when the rear of the preceding sheet was detected by the sheet-pass detecting means.

The present invention is thus configured, and in accordance with the first aspect of the invention, when, for example, the rear of a sheet has passed by the sheet-pass detecting means, the operation of the feed roller can be started so that the timing of starting the delivery of the next sheet can be made earlier.

In accordance with the second aspect of the invention, the operation in the above first feature of the invention, can be obtained by a very simple configuration, which has two actuators arranged in the sheet conveyance path with only a common optical sensor.

In particular, as shown in FIG. 1, an optical sensor 116 provided corresponding to a sheet-feed actuator 115 can detects the front and rear ends of sheets via a slit 115*b* of a slit arm 115*a* integrally formed in the lower part of sheet-feed actuator 115. The above optical sensor 116 also detect the front and rear ends of sheets via a slit 109*b* of a slit arm 109*a* provided for a sheet-pass actuator 109. As a result, as the actuators in the sheet-feed detecting means and sheet-pass detecting means sway in accordance with the delivery of sheets, the operational states of these actuators can be detected by optical sensor 116, so that it is possible to control the operation of the feed roller based on the output signal from the optical sensor.

In accordance with the above third and fourth features of the invention, in the above first and second configurations of the invention, the interval between sheets can be reduced to half the distance from the sheet-feed detecting means to the sheet tray, i.e. the feed roller, and this interval can be kept uniform within the range.

Next, in accordance with the above fifth and sixth features of the invention, in the above first and second configurations of the invention, the delivery and feeding of sheets can be controlled without causing deficiencies such as overlap between the rear end of the preceding sheet and the front end of the subsequently sheet. It is possible to reliably detect the front end of a sheet being conveyed using the sheet-feed detecting means, so as to definitely produce a signal indicating the start of the next operation, for example, the image forming operation.

In accordance with the above seventh and eighth features of the invention, in the above first and second configurations of the invention, the sheet-feed detecting means always detects the rear of the preceding sheet before detecting the front end of the next sheet which even has been in the dragged state. That is, the sheet-feed detecting means can first detect the rear of the preceding sheet and then detect the front end of the next sheet.

In accordance with the above ninth and tenth features of the invention, in the above fifth and sixth configurations of the invention, no overlap between the rear of the preceding sheet and the front end of the next sheet occurs within the operational range of the sheet-feed detecting means, thus making it possible to reliably detect the rear and front ends of sheets.

DESCRIPTION OF THE PREFERRED EMBODIMENTS

Figure 1:
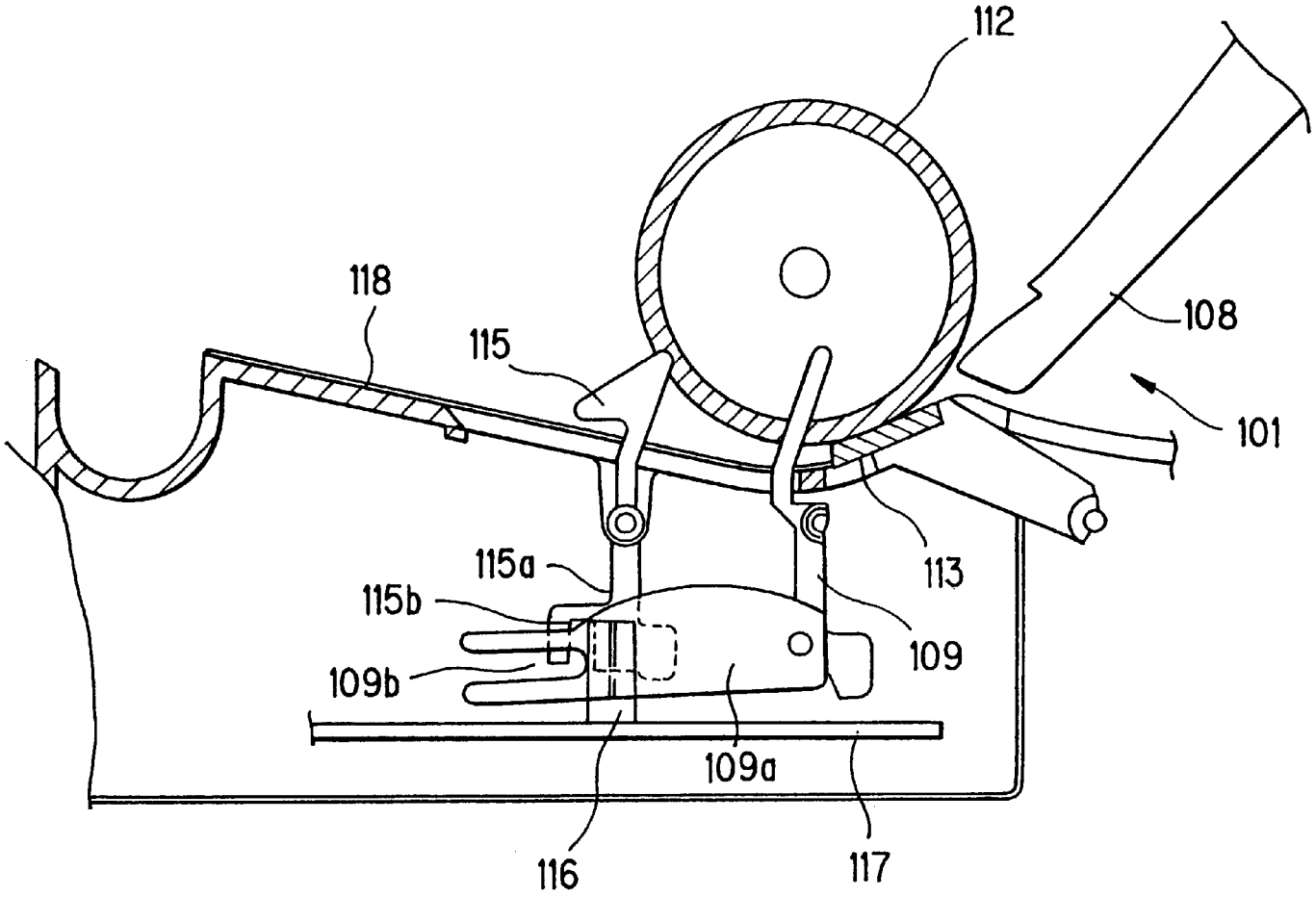
FIG. 1 is a sectional view showing the overall configuration of a sheet delivering and feeding device in accordance with the invention.
Figure 2:
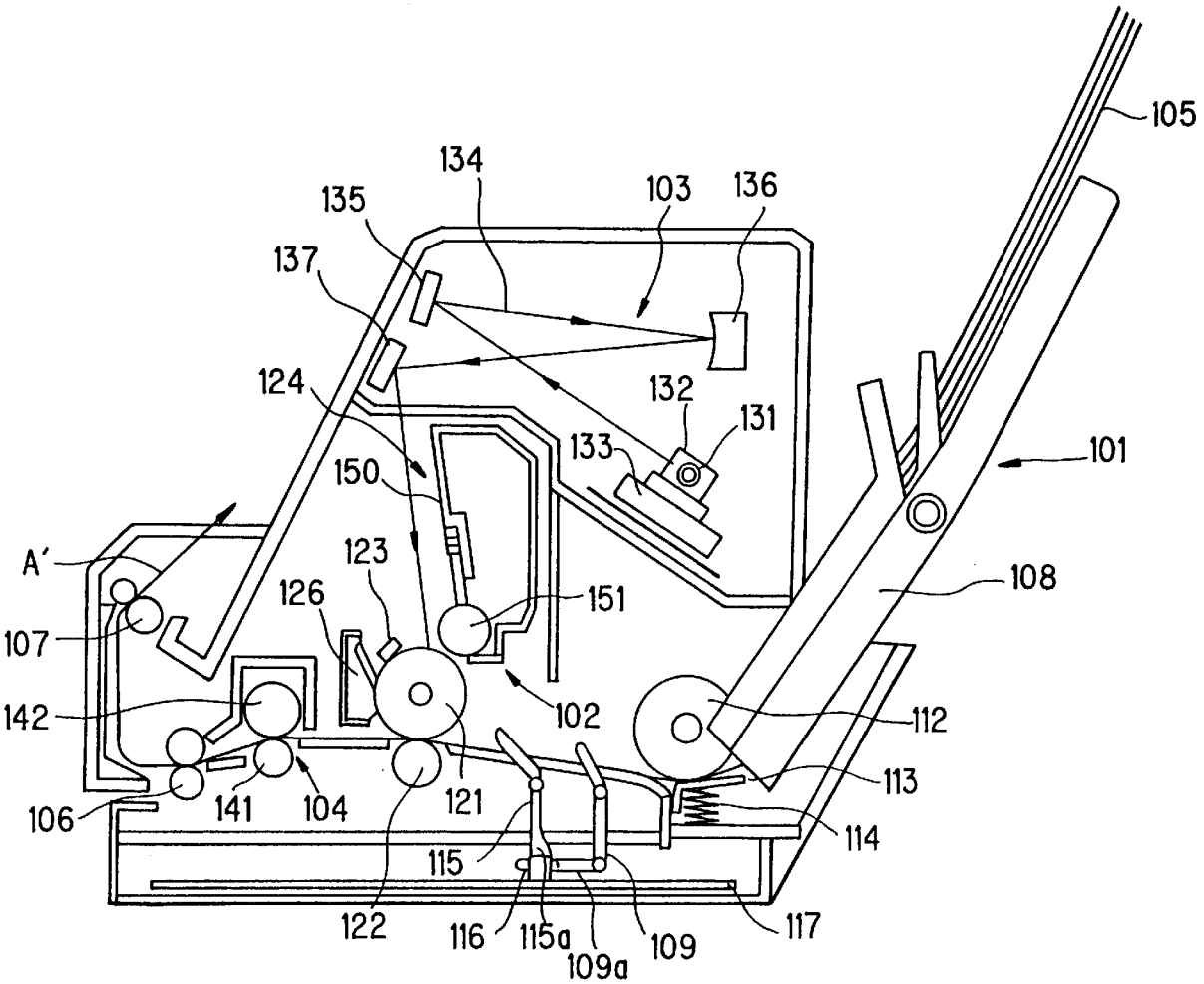
FIG. 2 is a sectional view showing the overall configuration of an image forming apparatus having the sheet delivering and feeding device shown in FIG. 1.

The embodiment of the invention will hereinafter be described stepwise in detail with reference to the accompanying drawings. FIG. 1 is a view showing essential components constituting a sheet delivering and feeding device in accordance with the invention. FIG. 2 is a sectional view showing the overall configuration of an image forming apparatus having the sheet delivering and feeding device of the invention.

Referring first to FIG. 2, the overall configuration of the image forming apparatus will be described. The image forming apparatus shown in FIG. 2 is a compact type laser printer.

This laser printer has a paper feeder 101 constituting the sheet delivering and feeding device of the invention, an image forming portion 102, a laser scanner 103 and a fixing unit 104. Paper feeder 101 delivers sheets 105 one by one to image forming portion 102 inside the printer.

In image forming portion 102, a static latent image is formed on the surface of a photoreceptor drum 121, in accordance with the optical information illuminated by laser scanner 103, and the toner image corresponding to this static latent image is transferred to the sheet 105 being conveyed from the aforementioned paper feeder 101.

Fixing unit 104 fixes the toner image formed on the sheet 105 after transfer. Then, sheet 105 is discharged by means of conveyer rollers 106 and 107 outside the printer. Briefly, sheet 105 is conveyed from paper feeder 101 through a conveying path shown by a bold arrow A in the figure.

In response to the instruction allowing the start of image forming (print), sheets 105 stacked on paper feeder 101, are delivered sheet by sheet by the actions of feed roller 112, a sheet separation frictional plate 113 and a pressure spring 114 and conveyed to the printer interior. When the sheet 105 thus fed pushes over sheet-pass and sheet-feed actuators 109 and 115 constituting the sensors for sheet detection, the information is outputted as an electric signal from a common sheet detecting optical sensor 116. This signal is processed as an instruction signal for indicating the start of image forming, i.e., the start of the operation of forming an image on photoreceptor 121.

When the aforementioned sheet detecting actuator 115 is triggered, a signal from optical sensor 116 is sent to a control circuit (board) 117. Then, this control circuit 117 sends out an image signal to a laser diode emitter unit 131 in laser scanner 103 to perform on/off control of the light emitting diode. A scanning mirror 132 is uniformly driven at a high speed by means of a scanning mirror motor 133. Therefore, laser beam 134 scans photoreceptor drum 121 along its axial direction.

Laser beam 134 emitted from laser diode emitter unit 131 passes through reflection mirrors 135, 136 and 137 to be radiated onto photoreceptor 121 in image forming portion 102. During this, laser beam 134 selectively illuminates the surface of drum-shaped photoreceptor 121 in accordance with the on/off information from the aforementioned control circuit 117.

As a result, this laser beam 134 selectively discharges the static charge on the surface of photoreceptor 121 which has been previously uniformly electrified by means of a charger 123, thus a static latent image is formed on photoreceptor 121.

On the other hand, the toner to be used for the development is stored in a developing unit 150 in developing device 124. The toner which has been appropriately agitated and tribo-electrified in developing unit 150 adheres onto the surface of a developing roller 151. The action of an electric field generated by a developing bias voltage applied to developer roller 151 and the surface potential of photoreceptor drum 121 causes the toner to adhere to the static latent image, forming a toner image on photoreceptor 121.

Accordingly, the sheet 105 delivered from paper feeder 101 into image forming portion 102 is fed into the transfer station between photoreceptor 121 and a transfer roller 122, where the toner image created on the surface of photoreceptor 121 is transferred. Illustratively, the toner image on photoreceptor 121 is electrically attracted by the action of the electric field generated by a transfer voltage applied to transfer roller 122 so that it transfers to sheet 105.

After this transfer, some toner remaining untransferred on the surface of photoreceptor 121 is removed therefrom and collected by a cleaning unit 126.

On the other hand, sheet 105 with the toner image transferred thereon is separated from photoreceptor 121 and then is conveyed to fixing unit 104, where it is appropriately heated and pressed by a pressing roller 141 and a heat roller 142 which is kept at a temperature of one hundred and some tens of degrees. As a result, the toner of the toner image is fused and fixed on sheet 105 forming a stable image. Sheet 105 with toner fixed thereon is conveyed by conveying rollers 106 and 107 and discharged to the outside of the apparatus.

(The first embodiment)

In the image forming apparatus thus configured, when, in particular, sheet-feed actuator 115 is triggered by the front end of the sheet 105 delivered and conveyed in the conveyance path by feed roller 112, this state is detected by optical sensor 116 and the detection signal is outputted.

In response to the output of this signal, the operation of forming an image on photoreceptor 121 in image forming portion 102 starts.

In the first embodiment of the invention, when the rear of the sheet has passed by sheet-feed actuator 115 and this state is detected by the aforementioned optical sensor 116, not only is the next sheet fed but also the setting of the next sheet can be performed prior to the feeding action, to thereby achieving sheet delivery with a short interval between sheets. For this purpose, a pivotable, sheet-pass actuator 109, which is triggered by the front end of a sheet being conveyed and serves for sheet detection, as a sheet-pass detecting means, is provided between sheet-feed actuator 115 and feed roller 112. Sheet-feed actuator 115 in cooperation with optical sensor 116 constitutes a sheet-feed detecting means.

Sheet-feed actuator 115 and sheet-pass actuator 109 have slit arms 115*a* and 109*a*, respectively, which are disposed between the light emitting and receiving elements of optical sensor 116.

Optical sensor 116 is composed of a photo interrupter which has light emitting and receiving elements disposed with a space in between so as to form an optical path for the light from the light emitting element to the light receiving element. The above actuators 109 and 115 are arranged so that their slit arms 109*a* and 115*a* interrupt the optical path between the light emitting and receiving elements.

Slit arm 115*a* which is linked with the movement (swaying) of sheet-feed actuator 115 has a slit 115*b* opening downwards and is integrally formed with the actuator so that it can simultaneously rotate about a rotary shaft of sheet-feed actuator 115. Slit arm 109*a* is pivotally supported at a lower portion of sheet-pass actuator 109 so that it can move in left-to-right directions in conformity with the rotational movement of sheet-pass actuator 109. This slit arm has a slit 109*b* formed along this direction of movement.

Slits 115*b* and 109*b* of slit arms 115*a* and 109*a* are formed to allow optical path of optical sensor 116 to open. In the state where the sheet-feed actuator and sheet-pass actuator are not actuated, these slits will be out of the optical path so that the arms block the optical path. In this state, no light-reception signal is generated from optical sensor 116. In the state where a sheet is conveyed through sheet conveyance path 118 with sheet-feed actuator 115 and sheet-pass actuator 109 arranged therein, when the both are actuated simultaneously, slits 115*b* and 109*b* allow the optical path to open, thus a light-reception signal is outputted from optical sensor 116.

Actuators 109 and 115 are provided so that their front ends are located in the sheet conveyance path (118) for sheet 105. Illustratively, these front ends are projected out through openings formed in guide 118 forming sheet conveyance path (118). Each shaft of actuators 109 and 115 is pivotally supported by supporters provided under conveyance guide 118.

When both sheet-feed and sheet-pass actuators 115 and 109 are actuated, the optical path of optical sensor 116 is open so that a light-reception signal is produced. That is, when sheet-feed actuator 115 is actuated by the front end of sheet 105, a triggering signal for starting the image forming operation can be obtained from optical sensor 116, as in the conventional manner.

Then, when the rear of the sheet has passed through sheet-pass actuator 109, slit arm 109*a* interrupts the optical path of optical sensor 116. At this moment, optical sensor 116 outputs a signal indicating that the rear of the sheet has passed by sheet-pass actuator 109. Therefore, a sheet-pickup signal for starting the feeding operation of feed roller 112 can be outputted in order to start the delivery of the next sheet 105, at this moment. Thus, it is possible to shorten the interval between sheets and hence a greater amount of sheets can be delivered per unit time, practically enhancing the speed of image forming.

Further, the first embodiment of the invention can be realized by providing only sheet-pass actuator 109 between sheet-feed actuator 115 and feed roller 112 while making optical sensor 116 serve for detection of both sheet-pass and sheet-feed actuators 109 and 115. Naturally, this configuration results in a reduction in cost.

Figure 4:
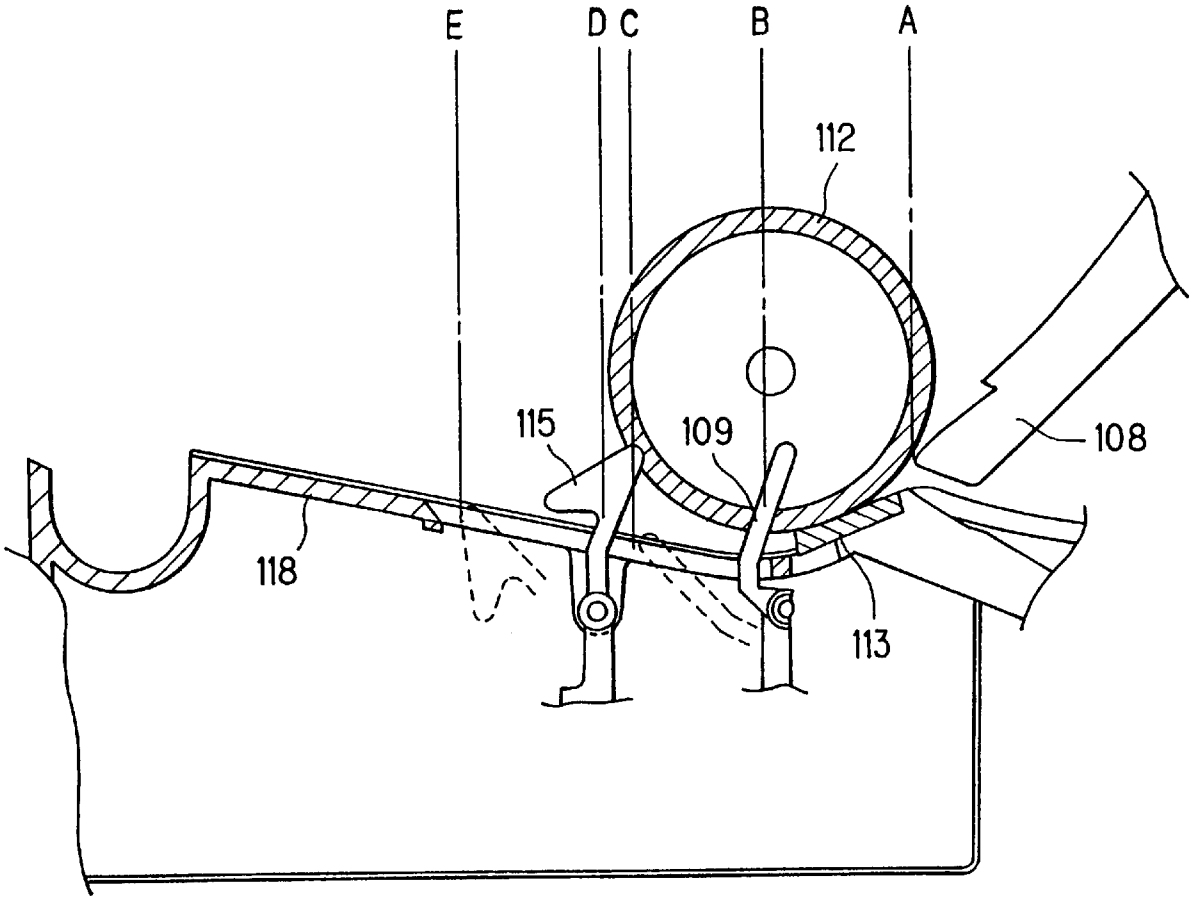
FIG. 4 is an illustrative view for explaining the operational ranges when a sheet being conveyed is detected in the invention.

FIG. 4 is a view for explaining the sheet feed timing in accordance with the invention. In this chart, a point A designates the front end of sheet tray 108 or the front end of sheet 105 set therein; point B the detection starting position (operation starting position) of sheet-pass actuator 109 at which the front end of the sheet is detected; point C the sheet rear detecting position (operation ending position) of sheet-pass actuator 109 at which the passage of the rear of the sheet is detected; point D the detection starting position (operation starting position) of sheet-feed actuator 115 at which the front end of the sheet is detected; and point E the sheet rear detecting position (operation ending position) of sheet-feed actuator 115 at which the passage of the rear of the sheet is detected.

Here, dashed lines indicate the states where actuators 115 and 109 are detecting sheet 105. Accordingly, the span B-C designates the range (operational range) in which sheet-pass actuator 109 is activated by the sheet being conveyed. If the front end of the next sheet is delivered while the rear of the preceding sheet is being conveyed between points B and C, the front end of the next sheet cannot be detected; that is, the operational range is the hysterisis of actuator 109.

Sheet-pass actuator 115 has an operational range of the span D-E. Therefore, if the front end of the next sheet is delivered while the rear of the preceding sheet is being conveyed between points D and E, the front end of the next sheet cannot be detected; that is, the operational range is the hysterisis of actuator 115.

In FIG. 4, when, in response of the sheet-pickup signal based on the instructions of starting image forming, feed roller 112 starts to be driven to deliver one of sheets 105 stacked on sheet tray 108, the first sheet 105 is separated from the stack by the function of frictional member 113 and is conveyed whilst successively actuating or pushing over sheet-pass actuator 109 and sheet-feed actuator 115 to the positions shown in the dashed line.

When the first sheet 105 is fed into the machine interior and its rear end passes by the rear end detection position, or point C at which sheet-pass actuator 109 detects the passage of the rear of the sheet, slit arm 109*a* of sheet-pass actuator 109 returns to the position which is shown by the solid line in FIG. 1. Then, when the rear end of sheet 105 passes by the sheet rear detection position or point E of sheet-feed actuator 115, sheet-feed actuator 115 returns to the position which is shown by the solid line in FIG. 1.

Now, referring to time charts shown in FIGS. 5A and 5B, the operation for picking up and delivering the next sheet 105 will be described in detail based on the relationship between the operational states of the actuators and the positions of the sheets, especially with reference to the detected states. This description of the operation will involve FIG. 4.

Figure 5A:
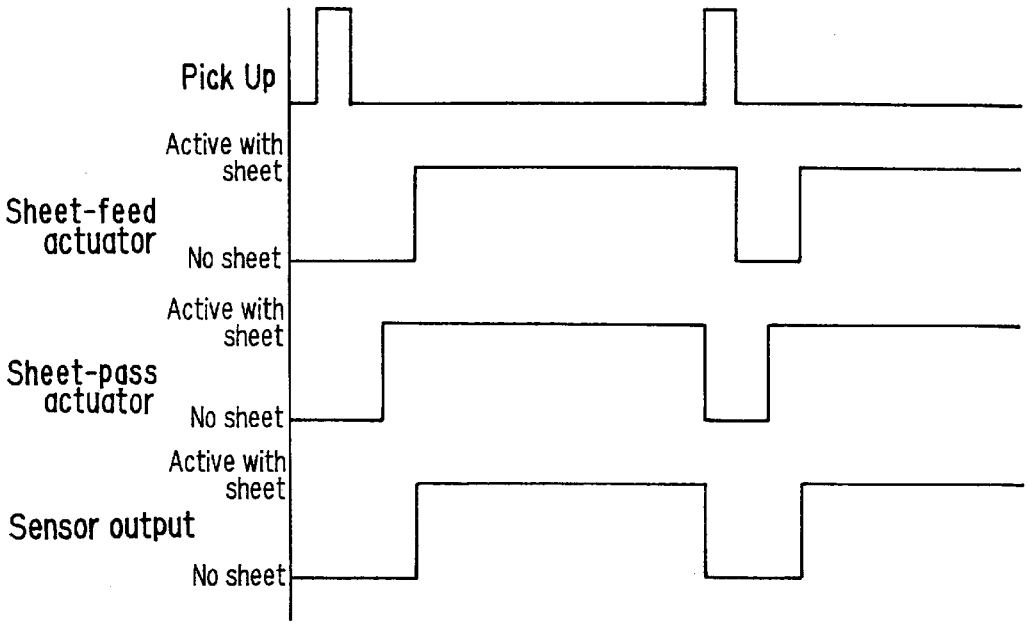
FIGS. 5A and 5B are time charts showing the timing of controlling the operation of delivering and feeding sheets by the sheet delivering and feeding device in accordance with the first embodiment of the invention.

First, with reference to the time chart of FIG. 5A, the first sheet is delivered, as stated above, by the rotation of feed roller 112 which is driven in response to the sheet-pickup signal outputted based on the instruction for starting image forming. The driving time of rotation of feed roller 112 is set longer to a degree than the time required for the front end of the sheet to reach the press-contact position between photoreceptor 121 and transfer roller 122, as already described. The first sheet is conveyed between points A and B by the operation of feed roller 112, and first actuates sheet-pass actuator 109. This operation state is shown by a rise-transition in the time chart, but this will cause no detection signal of the front end of the sheet to be produced from optical sensor 116.

When the front end of the first sheet is delivered to the span B-C, further proceeding to point D, the sheet-feed actuator 115 starts to be operated. This operational state is shown in the same manner for the rise-transition of the actuator 109. At this moment, because both slits 109*b* and 115*b* of slit arms 109*a* and 115*a* of actuators 109 and 115 are positioned in the optical path of optical sensor 116, a light reception signal is produced. That is, optical sensor 116 outputs a front end detecting signal (rise-transition signal in the waveform of the sensor output), indicating that the front end of the sheet has reached the position of sheet-feed actuator 115. In response to this detecting signal, a signal which indicates the start of the operation of forming an image on photoreceptor 121 can be obtained.

When the rear of the first sheet 105 has passed by the rear end detecting position C of sheet-pass actuator 109, actuator 109 returns to the original position. Accordingly, the optical path of optical sensor 116 is interrupted by the non-slit portion of slit arm 109*a* of sheet-pass actuator 109, producing a non-light reception signal. In other words, when the fall-transition signal from the light-reception state to the non-light reception state is outputted, this means the detection of the rear of the sheet. In response to this signal, a sheet-pickup signal is outputted so as to cause feed roller 112 to start the operation of delivering the next sheet. In delivering this next sheet 105, when its front end reaches sheet-feed actuator 115, a rise-transition signal indicating the detection of the front end is outputted from optical sensor 116, in the same manner as above. In this way, it is possible to reliably obtain the indication signal for starting image forming for the next sheet.

In the above description, especially the time chart of FIG. 5A shows the case where the next sheet is delivered by the action of feed roller 112, in particular, when it is passively turned by the preceding sheet, and the next sheet is in the dragged state and positioned between points A and B (in the state of FIG. 3) before triggering sheet-pass actuator 109. Accordingly, the following sheet 105 will be delivered with a sheet interval of the distance A-C at maximum. In the conventional configuration, the delivery of the sheet was performed with a sheet interval of the distance A-E.

Figure 5B:
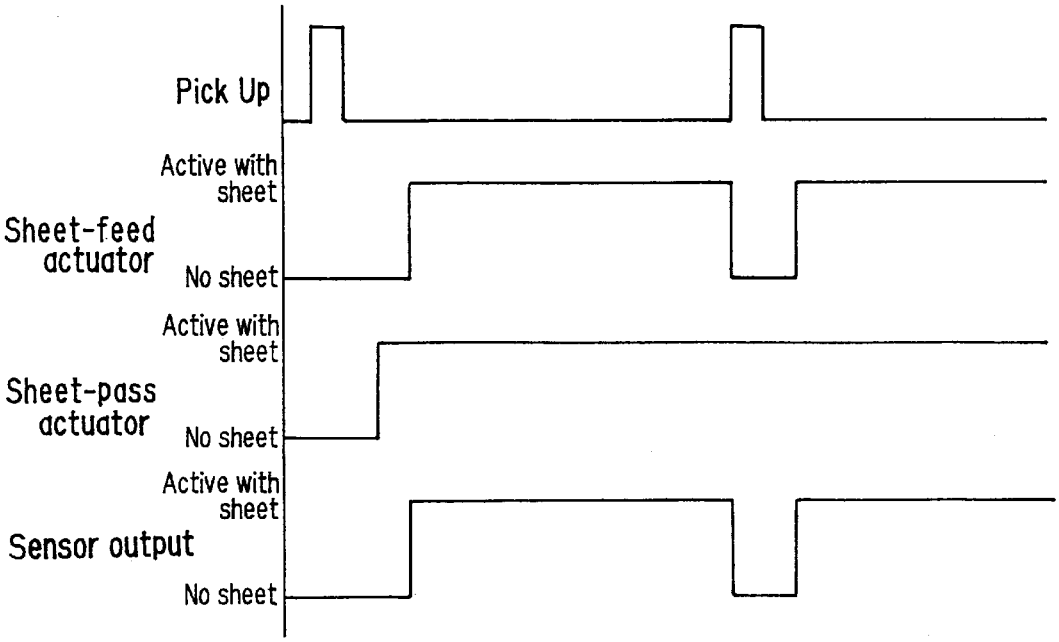

The time chart shown in FIG. 5B shows the case where the front end of sheet 105 is dragged up to the range between points B and D by the conveyance of the preceding sheet. In this case, the events are the same as that in the case of FIG. 5A until the preceding sheet 105 is conveyed and its front end is detected. However, even when the rear of the preceding sheet 105 has passed by the point C, the sheet-pass actuator 109 does not return to the original position but remains in the detected state kept there by the next sheet 105. Accordingly, even when the rear of the preceding sheet passes by the point C, the operation ending position of sheet-pass actuator 109, no rear end detection signal will be produced from optical sensor 116.

Only after the rear end of the preceding sheet 105 has passed by point E, which is the rear end detecting position of sheet-feed actuator 115, optical sensor 116 outputs a fall-transition signal. That is, after the rear end of the sheet has passed by sheet-feed actuator 115, the rear end detection signal is outputted, and in response to this signal, a sheet-pickup signal for triggering the next sheet delivery is outputted.

In this operation, the delivery of sheet is triggered when sheet-feed actuator 115 detects the rear of the sheet. At this moment, the delivery of the next sheet is started from the state where its front end is positioned between points B and C because the sheet is dragged by the feed roller during the conveyance of the preceding sheet. As a result, the interval between the rear of the preceding sheet and the front end of the next sheet is not the distance between points A and E but the distance between points B and E at maximum.

As described heretofore, even when the next sheet has been dragged by the action of the preceding sheet, the interval between sheets is the distance between points A and C or between points B and E at maximum. It is understood that in either case, the sheet interval can be shortened. Besides, when the location of sheet-pass actuator 109 and the hysterisis of the operational state related to the passage of a sheet, or the distance (operational range) of each actuator, from the position indicated by the solid line to that by the dashed line in FIG. 4 are appropriately determined, it is possible to equate the distance A-C with the distance B-E to thereby make the two sheet intervals fall within the same range.

In the present invention, it is possible to provide a configuration in which each of the motions of two slit arms of sheet-pass actuator 109 and sheet-feed actuator 115 can be detected by the common optical sensor 116. This configuration will be described hereinbelow. As shown in FIG. 1, in one of the actuators, for example sheet-feed actuator 115, for example, the width (the width along the direction of rotation of actuator 115) of slit 115*b* of slit arm 115*a* of sheet-pass actuator 115 is set small and the light-blocking portion adjacent to the slit is also set narrow. Under this condition, the slit arm 115*a* is configured so that when sheet-feed actuator 115 rotates or moves from the position which is indicated by the solid line to that indicated by the dashed line as a sheet is conveyed, at the beginning slit 115*b* enters the optical path of optical sensor 116, then the light-blocking portion passes therethrough and thereafter the slit arm 115*a* itself is displaced from the optical path as the light blocking portion is passing by the optical path.

Figure 6A:
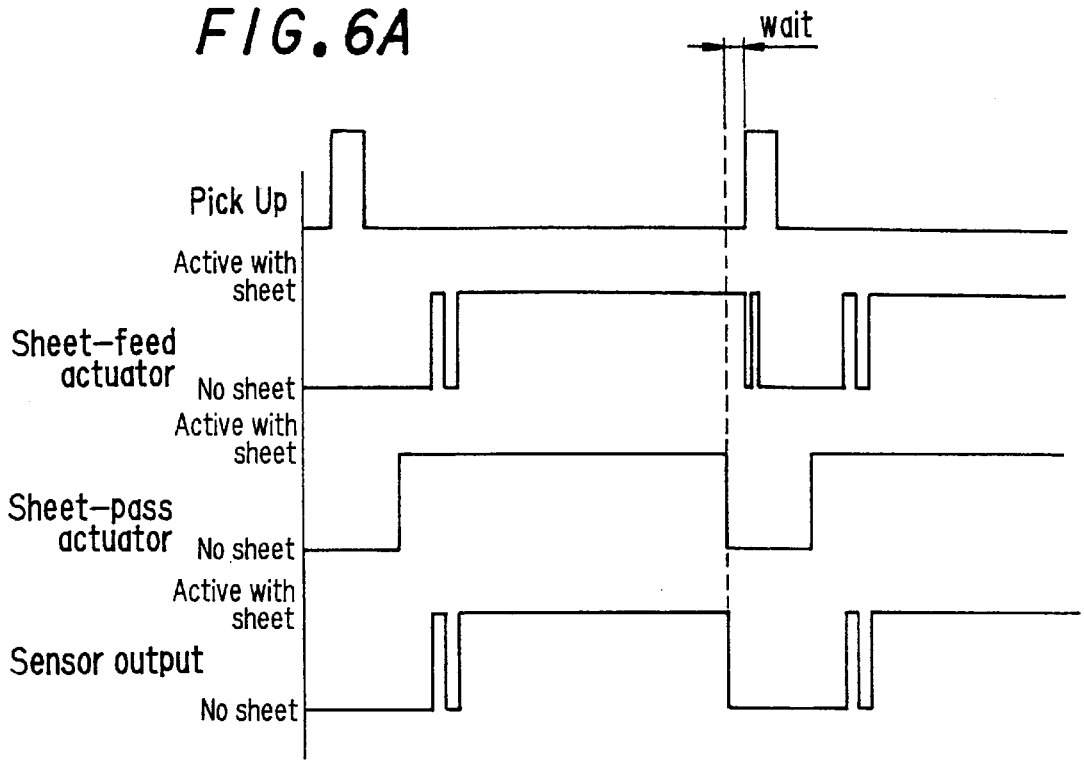
FIGS. 6A and 6B are time charts showing the timing of controlling the operation of delivering and feeding sheets by the sheet delivering and feeding device in accordance with a variation of the first embodiment shown in FIGS. 5A and 5B.
Figure 6B:
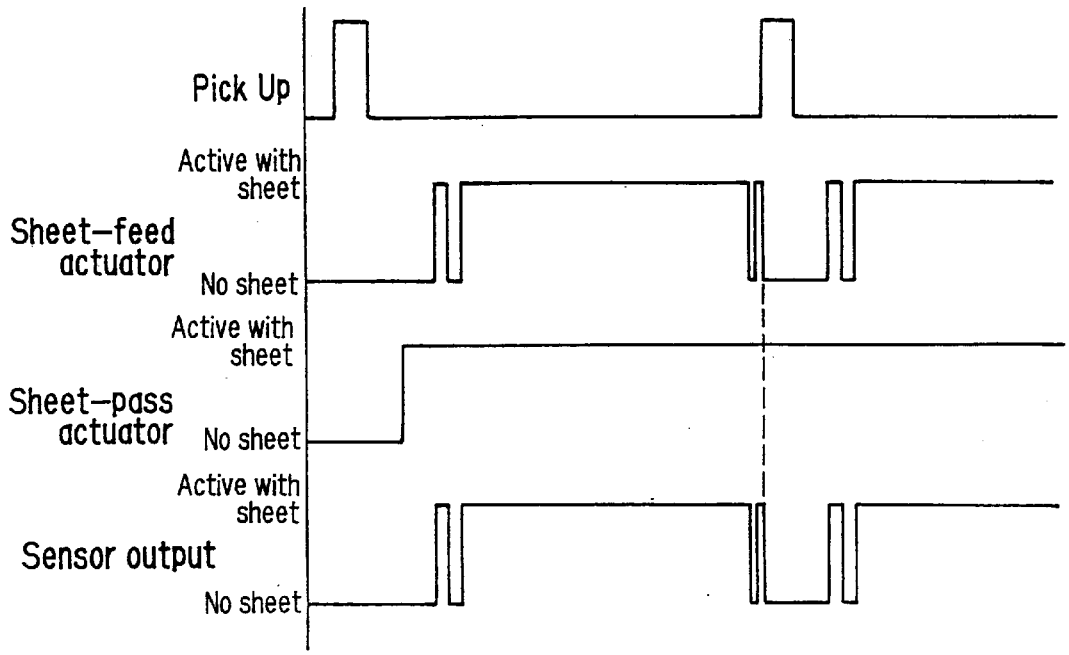

In this setting, waveforms shown in the time charts in FIGS. 6A and 6B are obtained. These charts show the cases where slit 115*b*, the light blocking portion and slit arm 115*a* itself successively pass by optical path of optical sensor 116, in order to make the motion of sheet-feed actuator 115 distinct. By this setting, when two continuous rise-transition outputs within a short span of time appear in the output waveform from optical sensor 116, it can be easily recognized that sheet-feed actuator 115 has detected the front end of a sheet. When two continuous fall-transition outputs within a short span of time appear, it can be easily recognized that sheet-feed actuator 115 has detected the rear end of a sheet.

Concerning sheet-pass actuator 109, when the rise- or fall-transition appears solely in the output waveform from optical sensor 116, it can be determined that sheet-pass actuator 109 has detected the front or rear end of a sheet.

Similarly to the timing charts of FIGS. 5A and 5B, the time charts in FIGS. 6A and 6B show the cases where the next sheet has been dragged by the conveyance of the preceding sheet; specifically, FIG. 6A shows the case where the front end of a sheet is located between points A and B, and FIG. 6B shows the case where the front end is between points B and C.

In FIG. 6A, the sheet-pickup signal for starting the delivery of the next sheet is outputted when optical sensor 116 detects the rear of the sheet via sheet-pass actuator 109. In FIG. 6B, the sheet-pickup signal for the next sheet is outputted when optical sensor 116 detects the rear of the sheet via sheet-feed actuator 115. In this case, the image forming operation will be started in response to the signal corresponding to the detection of the front end of the sheet via sheet-feed actuator 115.

In the above case, the sheet-pickup signal is outputted in response to a rise-transition output from optical sensor 116 as stated above. In this case, since it can be recognized whether the signal is outputted by the detection of the rear of the sheet via sheet-feed actuator 115 or by the detection of the rear of the sheet via sheet-pass actuator 109, it is possible to perform different control operations in accordance with the output of the signals.

Illustratively, in the case of FIG. 6A, wait time is given before outputting the sheet-pickup signal. This is because the hysteresis of sheet-feed actuator 115 is greater than that of sheet-pass actuator 109. That is, in FIG. 4, the hysteresis is the operational range in which actuator 109 can detect the conveyance of a sheet or the distance from point B where sheet-pass actuator 109 is shown by the solid line to point C where the actuator is shown by the dashed line. Similarly, the hysteresis of sheet-feed actuator 115 is the operational range or the distance between point D where the actuator is shown by the solid line and point E where it is shown by the dashed line.

Figure 3:
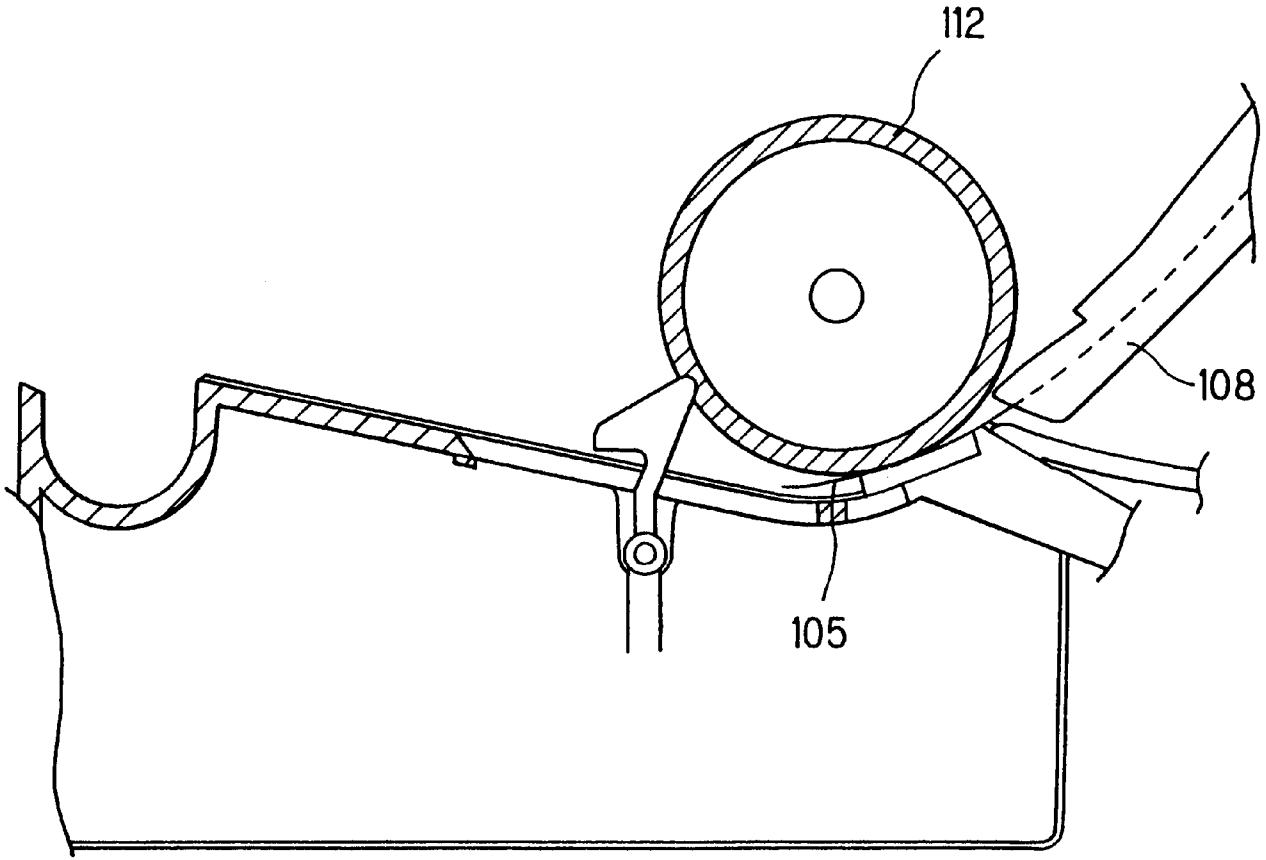
FIG. 3 is a schematic view showing the state of a subsequent sheet being dragged, in accordance with the invention.

In the above condition where the hysterisis of sheet-feed actuator 115 is greater than that of sheet-pass actuator 109, assume a case where when the front end of the dragged sheet 105 as shown in FIG. 3 is located between points A and B, the feed roller starts to be driven in response to the output generated when sheet-pass actuator 109 has detected the rear of the preceding sheet at the rear end detecting position C. In such a case, the front end of the next sheet may reach the span D-E before the rear of the preceding sheet has passed by the rear end detecting position E of sheet-feed actuator 115. If this happens, sheet-feed actuator 115 comes into a state where it cannot detect the front end of the next sheet and hence it becomes impossible to output an indication signal for starting the image forming operation.

In order to avoid such a situation, under the condition of FIG. 6A, in response to the fall-transition signal of optical sensor 116 when sheet-pass actuator 109 detects the rear of the sheet, a sheet-pickup signal is outputted providing the wait time (a prescribed period of time) so as to avoid the front end of the next sheet being improperly delivered to the span D-E, as shown in the chart. This ensures the detection of the front end of the next sheet after the passage of the rear end of the preceding sheet.

In the time charts shown in FIGS. 5A and 5B, the hysteresis of sheet-pass actuator 109 is greater than that of sheet-feed actuator 115. In this case, there is no need to provide any wait time stated above. This is because, the front end of the next sheet will not reach point D until sheet-feed actuator 115 returns to point D, which is the stand-by position of it, after the rear of the preceding sheet has passed by point E of sheet-feed actuator 115.

(The second embodiment)

In the embodiment having the above configuration, the front end detection signal is obtained from optical sensor 116 when sheet 105 delivered by feed roller 112 has reached sheet-feed actuator 115, and sheet-pass actuator 109 is provided between actuator 115 and feed roller 112 so as to allow the same optical sensor 116 to detect the passage of the rear of the sheet.

In the image forming apparatus shown in FIG. 2, sheet 105 is fed into the transfer station by means of feed roller 112; no other means for conveying sheets are provided in between. Therefore, the image forming operation is adapted to start in response to the detection of the front end of the sheet by sheet-feed actuator 115.

In order to shorten the sheet interval, sheet-pass actuator 109 is provided between the feed roller and sheet-feed actuator 115 and the operations of the actuators are detected by the common optical sensor 116.

In contrast, in accordance with the second embodiment, instead of providing a common optical sensor 116, each actuator is provided with its own optical sensor. This control of feeding and delivering sheets will be described herein below.

Figure 7:
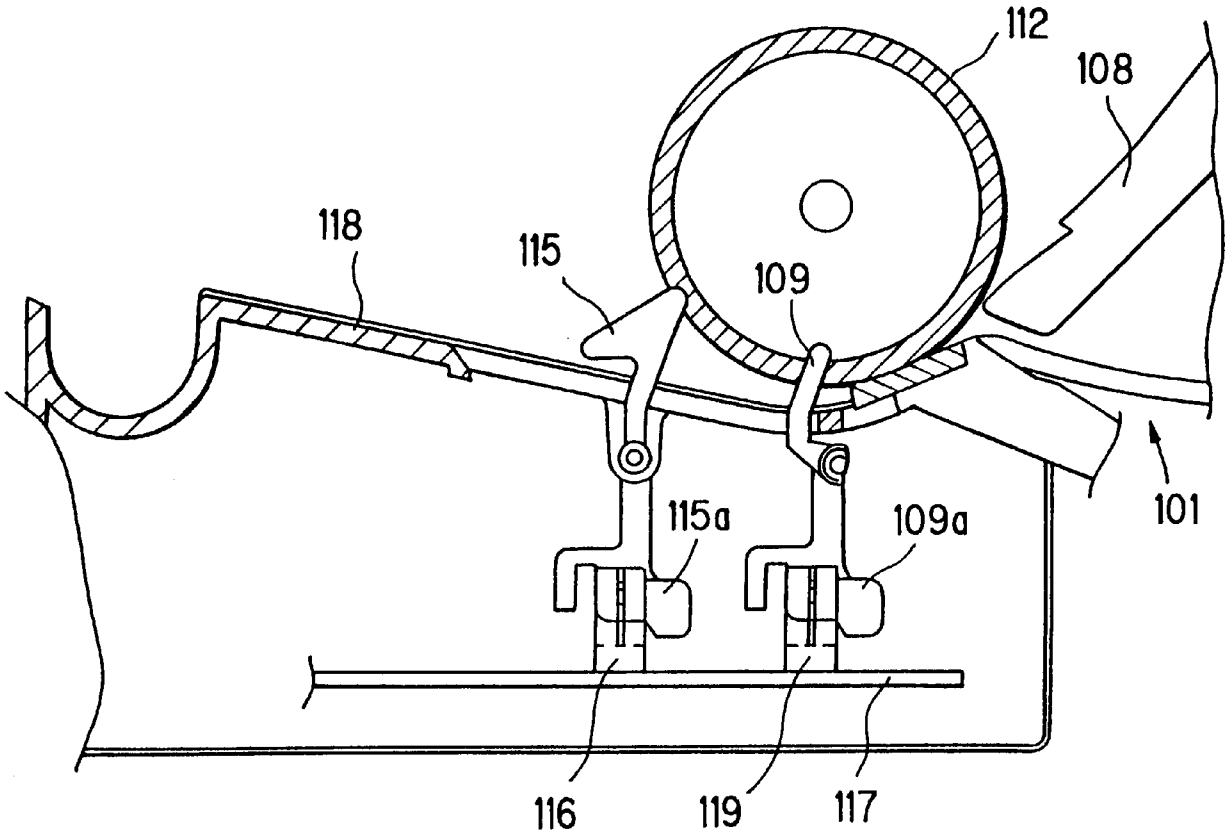
FIG. 7 is a sectional view showing the overall configuration of a sheet delivering and feeding device in accordance with the second embodiment of the invention.

FIG. 7 shows a configuration in which sheet-pass actuator 109 is arranged between sheet-feed actuator 115 and feed roller 112. An optical sensor 119 is provided to detect the swaying state in accordance with the sheet conveyed through the position of sheet-pass actuator 109, thus constituting a sheet-pass detecting means (sheet-pass sensor). Provided for sheet-feed actuator 115 is another optical sensor 116, thus constituting a sheet-feed detecting means (sheet-feed sensor).

Sheet-feed actuator 115 and sheet-pass actuator 109 have slit arms 115*a* and 109*a* which each have a slit therein, and are interposed in respective optical paths of optical sensors 116 and 119. Therefore, each of optical sensor 116 and 119 will output an independent detection signal when swayed in accordance with the delivery and feeding of a sheet through sheet-feed actuator 115 or sheet-pass actuator 109.

The feeding operation of sheets in this configuration will be described with reference to the time charts shown in FIGS. 8A and 8B and FIGS. 9A and 9B. The description of the delivery and feeding states of sheets will be made with reference to FIG. 4.

Figure 8A:
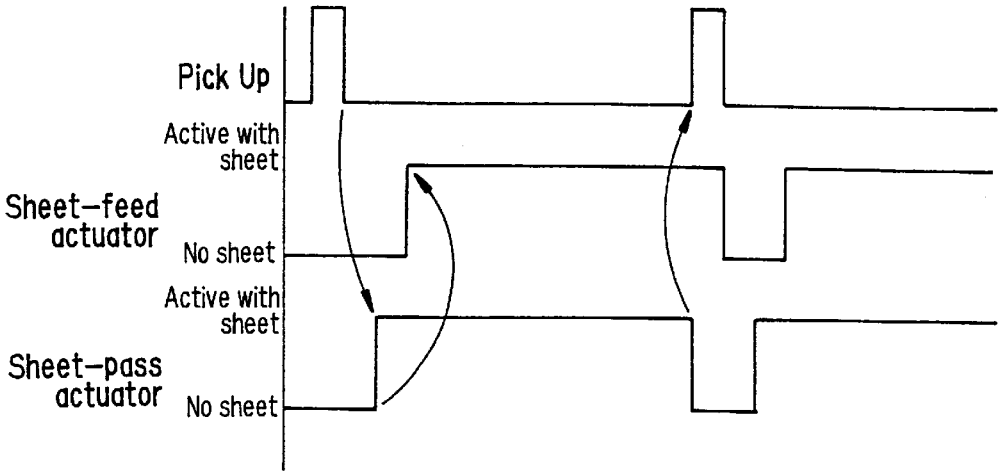
FIGS. 8A and 8B are time charts showing the timing of controlling the operation of delivering and feeding sheets by the sheet delivering and feeding device in accordance with the second embodiment of the invention.
Figure 8B:
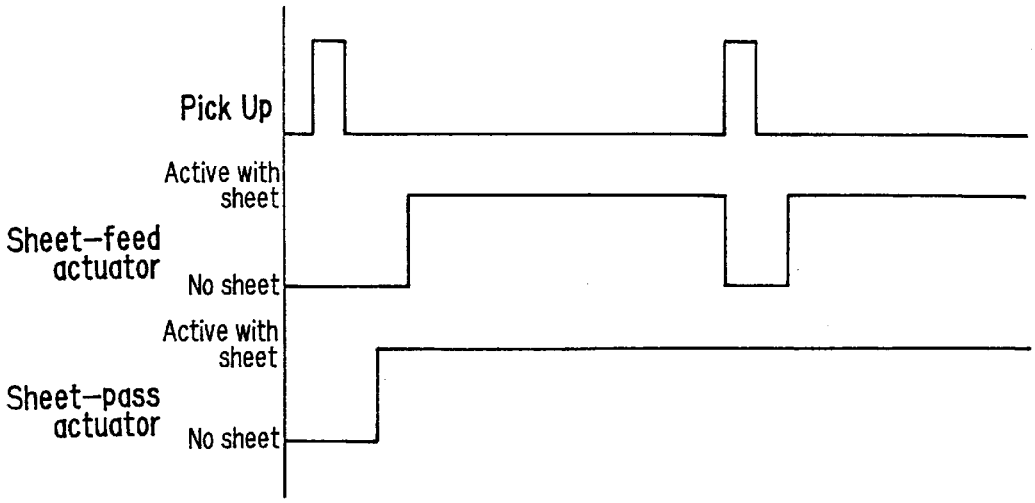

In FIGS. 8A and 8B, description will be made of the cases where the front end of sheet 105 in the dragged state is located between points A and B and between points B and C in FIG. 4. In the case where the front end of sheet 105 is in the dragged state and located in points A and B (this case is shown in FIG. 8A), in response to a fall-transition signal detected by the sheet-pass sensor when the rear of the preceding sheet has passed by the point C of sheet-pass actuator 109, a sheet-pickup signal for activating feed roller 112 is outputted in order to deliver the next sheet.

In the case where the front end of the sheet to be delivered next is located between points B and C (this case is shown in FIG. 8B), even when the rear of the preceding sheet has passed by sheet-pass actuator 109, no detection signal will be outputted from the sheet-pass sensor because the front end of the next sheet is between points B and C. Therefore, no sheet-pickup signal for activating feed roller 112 will be outputted.

Thereafter, when the rear end of the preceding sheet has passed by the rear end detecting position E of sheet-feed actuator 115 of the sheet-feed sensor, the sensor outputs a sheet rear detection signal. In response to this output, a pickup signal is outputted in order to drive feed roller 112.

In the manner as in the first embodiment, it is also possible in this embodiment to perform a control operation of delivering and feeding sheets with a sheet interval of the distance A-C or B-E at maximum. Thus, it is possible to shorten the interval between sheets compared to the conventional configuration in which the sheet interval is optimally the distance A-E, and hence a greater amount of sheets can pass per unit time practically enhancing the speed of image forming, without increasing the speed of the operation of forming an image on photoreceptor 121.

Besides, in order to equate the distance A-C with the distance B-E, it is possible to appropriately set up the locations involving the hysterisis of sheet-feed actuator 115 and sheet-pass actuator 109, to thereby make the two sheet intervals consistent within the same range of variance.

The time charts in FIGS. 8A and 8B show the case where the hysteresis of the sheet-pass sensor (sheet-pass actuator 109) is equal to or greater than that of the sheet-feed sensor (sheet-feed actuator 115). However, in the case where the hysterisis of the sheet-feed sensor is greater than that of the sheet-pass sensor, there occur cases where the front end of the next sheet cannot be detected by the sheet-feed sensor, as described with reference to FIGS. 6A and 6B.

Figure 9A:
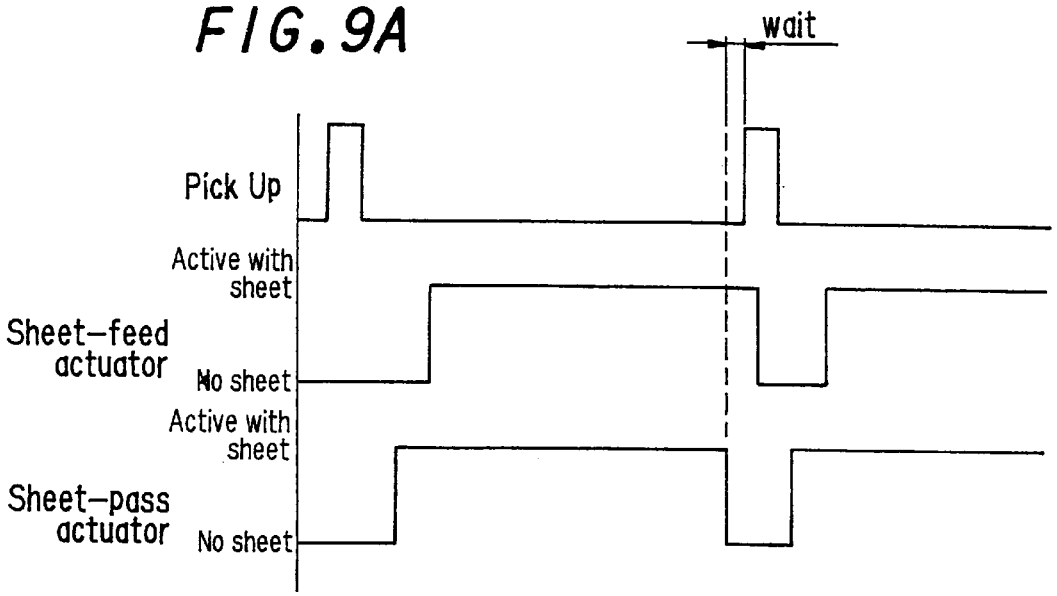
FIGS. 9A and 9B are time charts showing the timing of controlling the operation of delivering and feeding sheets by the sheet delivering and feeding device in another case in the second embodiment shown in FIGS. 8A and 8B.
Figure 9B:
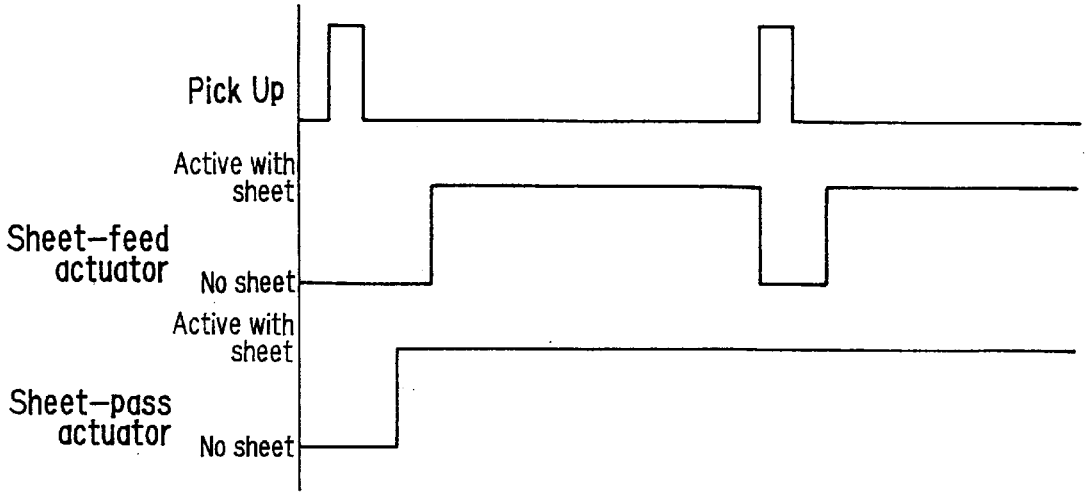

In order to eliminate the above deficiency, a signal of picking up the next sheet will not be outputted when the sheet-pass sensor has detected the rear end of the preceding sheet, but wait time is given before outputting the sheet-pickup signal, as shown in FIG. 9A. In the case where the front end of the sheet to be delivered next is located between points B and C in FIG. 4, since a sheet-pickup signal is outputted when sheet-feed sensor detects the rear of the preceding sheet as in FIG. 8B, no event which does not allow the sheet-feed sensor to detect the front end of the next sheet will occur regardless of the hysterisis.

(Other developments)

As shown in FIG. 1, slit arm 109*a* for sheet-pass actuator 109 differs from slit arm 115*a* integrally formed with sheet-feed actuator 115, being pivotally provided for actuator 109.

Optical sensor 116 is electrically connected and directly fixed to control circuit board 117 for performing drive control operation of feed roller 112 and controlling the start and operation of forming an image on photoreceptor 102. In this arrangement, slit arm 109*a* needs to be inserted into the spacing of optical sensor 116. However, this is a troublesome work because slit arm 109*a* is rotatably provided relative to actuator 109. To deal with this, a constraint member for limiting the rotation of slit arm 109*a* is provided in the lower part of actuator 109.

Figure 10A:
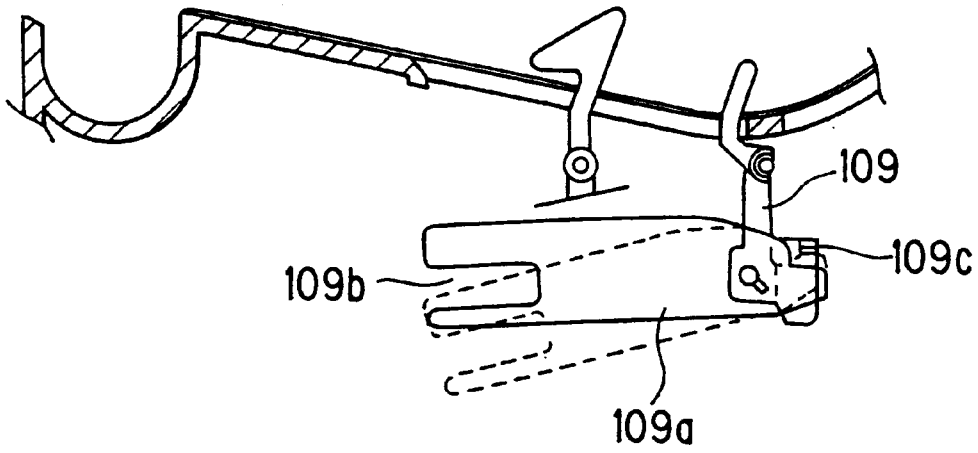
FIGS. 10A and 10B are sectional views showing the mounted state of the slit arm pivotally provided for the actuator constituting a sheet-pass detecting means.
Figure 10B:
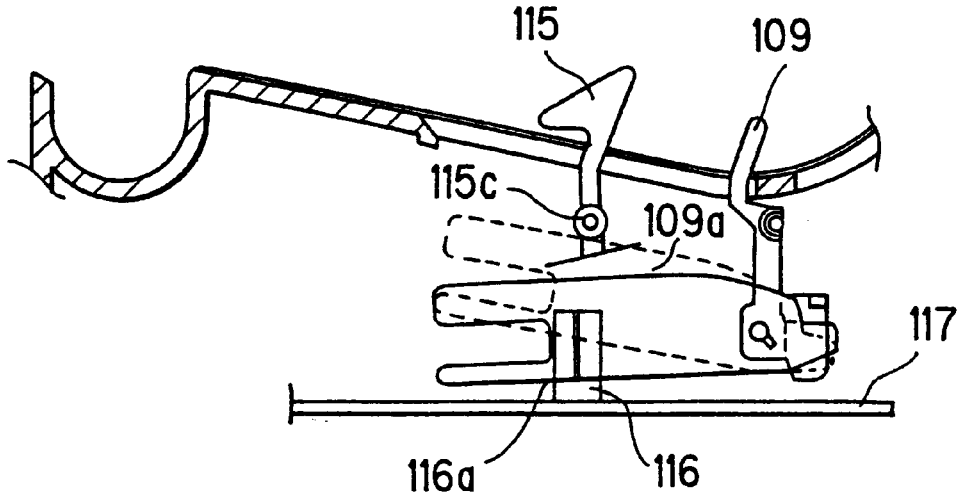

FIGS. 10A and 10B shows an example of this. As shown in FIG. 10A, a constraint member 109*c* for limiting the rotation of the slit arm in the counterclockwise direction is provided in the lower part of actuator 109. Accordingly, the rotation of slit arm 109*a* is limited with its end abutted against constraint member 109*c*. In this position, the slit arm can be easily inserted into the spacing of optical sensor 116 shown in FIG. 10B.

During the transportation of the image forming apparatus, slit arm 109*a* is positioned in the spacing of optical sensor 116 and restrained in this state. That is, as shown in FIG. 10B, the movement of slit arm 109*a* in the clockwise direction is limited by rotary shaft 115*c* of sheet-feed actuator 115 at the position indicated by a dashed line. Therefore, slit arm 109*a* will not rotate in the clockwise direction and hence will not come out of the spacing of optical sensor 116. Further, the rotation of slit arm 109*a* in the counterclockwise direction is limited by bottom 116*a* of the spacing of the optical sensor 116, therefore, the slit arm 109*a* will never depart from optical sensor 116.

In accordance with sheet delivering and feeding device of the invention, it is possible to constantly control the delivery and feeding of sheets with a sheet interval smaller than the distance between the sheet feed position and sheet feed detecting means. Thereby, it is possible to practically increase, for example, the speed of the image forming operation.

Since the sheet interval can be shortened by only providing an actuator which moves in response to the sheet delivered and fed, and functions using a common part constituting the sheet-feed detecting means, the reduction of the sheet interval can be realized with a minimum increase in cost.

By appropriately set up the operational range of sheet-feed detecting means, it is possible to perform reliable detection of sheets even when a detecting means for detecting the delivery and feeding of sheets between the sheet-feed detecting means and sheet feeder portion. Accordingly, it is possible to perform control of sheet delivery and feeding based on the reliable sheet detection without any deficiencies such as failures to detect the front end of sheet.

What is claimed is:

1. A sheet delivering and feeding device comprising:

a sheet tray for having sheets stacked thereon;

a feed roller for delivering sheets one by one from the sheet tray;

control means for starting a feed roller for delivering a sheet;

a frictional member disposed opposite the feed roller for preventing multiple delivery of sheets;

a sheet-feed detecting means for detecting the sheet delivered by the feed roller to produce a signal instructing the start of a sheet feeding operation;

a sheet-pass detecting means disposed in the sheet conveyance path between the sheet-feed detecting means and the feed roller for detecting a front and rear end of a sheet conveyed along the sheet conveyance path, wherein the start of the feed roller in response to said start signal for delivering the sheet is controlled in accordance with the detection states of the sheet-feed detecting means and the sheet-pass detecting means;

said sheet-feed detecting means and said sheet pass detecting means having a common optical sensor means.

2. The sheet delivering and feeding device according to claim 1, wherein the sheet-pass detecting means is disposed at the approximately center between the sheet-feed detecting means and the sheet tray.

3. The sheet delivering and feeding device according to claim 1, wherein the operation of the feed roller for delivering a sheet is started when the sheet-pass detecting means has detected the rear of the preceding sheet; and when the front end of the subsequent sheet has been dragged in the sheet-pass detecting means and is detected thereby, the feed roller is started when the sheet-feed detecting means has detected the rear of the preceding sheet.

4. The sheet delivering and feeding device according to claim 3, wherein when the operational range within which the sheet-feed detecting means detects sheets is set longer than that within which the sheet-pass detecting means detect sheets, the operation of the feed roller for delivering a sheet is started after a certain elapse of time from when the rear of the preceding sheet was detected by the sheet-pass detecting means.

5. The sheet delivering and feeding device according to claim 1, wherein the operational range within which the sheet-feed detecting means detects sheets is set shorter than that within which the sheet-pass detecting means detect sheets.

6. The sheet delivering and feeding device according to claim 1, wherein the sheet-pass detecting means includes two spaced actuators located substantially along the same longitudinal axis.

7. The sheet delivering and feeding device according to claim 6, where each actuator includes a slit.

8. The sheet delivering and feeding apparatus according to claim 7, wherein the sheet feed detecting means includes an optical sensor.

9. The sheet delivering and feeding apparatus according to claim 8, wherein the optical sensor and the actuators are operatively connected to each other.

10. A sheet delivering and feeding device comprising:

a sheet tray for having sheets stacked thereon;

a feed roller for delivering sheets one by one from the sheet tray;

control means for starting a feed roller for delivering a sheet;

a frictional member disposed opposite the feed roller for preventing multiple delivery of sheets;

a sheet-feed detecting means for detecting the sheet delivered by the feed roller to produce a signal instructing the start of a sheet feeding operation;

a sheet-pass detecting means disposed in the sheet conveyance path between the sheet-feed detecting means and the feed roller for detecting a front and rear end of a sheet conveyed along the sheet conveyance path, wherein the start of the feed roller in response to said start signal for delivering the sheet is controlled in accordance with the detection states of the sheet-feed detecting means and said sheet-feed detecting means, and the sheet-feed detecting means is disposed in the sheet conveyance path and comprises a sheet-feed actuator which is swayed by the delivered sheet and a sensor which detects the swaying state of the sheet-feed actuator to produce a signal indicating the sheet delivery and feeding state; and the sheet-pass detecting means is disposed in the sheet conveyance path and comprises a sheet-pass actuator which is swayed by the delivered sheet while the swaying state of the sheet-pass actuator is detected by the same sensor to detect the sheet delivery and feeding state.

11. The sheet delivering and feeding device according to claim 10, wherein the sheet-pass detecting means is disposed at the approximately center between the sheet-feed detecting means and the sheet tray.

12. The sheet delivering and feeding device according to claim 10, wherein the operation of the feed roller for delivering a sheet is started when the sheet-pass detecting means has detected the rear of the preceding sheet; and when the front end of the subsequent sheet has been dragged in the sheet-pass detecting means and is detected thereby, the feed roller is started when the sheet-feed detecting means has detected the rear of the preceding sheet.

13. The sheet delivering and feeding device according to claim 12, wherein when the operational range within which the sheet-feed detecting means detects sheets is set longer than that within which the sheet-pass detecting means detect sheets, the operation of the feed roller for delivering a sheet is started after a certain elapse of time from when the rear of the preceding sheet was detected by the sheet-pass detecting means.

14. The sheet delivering and feeding device according to claim 10, wherein the operational range within which the sheet-feed detecting means detects sheets is set shorter than that within which the sheet-pass detecting means detect sheets.

* * * * *